US006975281B2

(12) United States Patent
Neel

(10) Patent No.: US 6,975,281 B2
(45) Date of Patent: Dec. 13, 2005

(54) REDUCED SIZE DIELECTRIC LOADED SPIRAL ANTENNA

(75) Inventor: Michael M. Neel, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 39 days.

(21) Appl. No.: 10/839,447

(22) Filed: Apr. 30, 2004

(65) Prior Publication Data

US 2005/0243013 A1 Nov. 3, 2005

(51) Int. Cl.[7] ..... H01Q 1/36; H01Q 1/26

(52) U.S. Cl. ..... 343/895; 343/700 MS

(58) Field of Search ..... 343/759, 767, 343/785, 795, 796, 700 MS, 821, 822, 859, 343/895

(56) References Cited

U.S. PATENT DOCUMENTS

| | | | | |
|---|---|---|---|---|
| 4,431,965 A * | 2/1984 | Aslan | | 324/95 |
| 5,589,842 A * | 12/1996 | Wang et al. | | 343/787 |
| 5,936,594 A * | 8/1999 | Yu et al. | | 343/895 |
| 6,166,694 A * | 12/2000 | Ying | | 343/702 |
| 6,864,856 B2 * | 3/2005 | Lynch et al. | | 343/895 |

* cited by examiner

*Primary Examiner*—Hoang V. Nguyen
*Assistant Examiner*—Minh Dieu A
(74) *Attorney, Agent, or Firm*—David S. Kalmbaugh

(57) ABSTRACT

A spiral antenna having a pair of antenna arms mounted on a dielectric substrate. A balun is included to connect the antenna which has an impedance of 100 ohms to a 50 ohm cable. Unique features of the spiral antenna design provide for size reduction at a given lowest required frequency of operation. The spiral antenna has dielectric material layers positioned on both side of the antenna's metal arms. In addition, the antenna input impedance is reduced from the normal 100 ohm input impedance to approximately 50 ohms due the dielectric material.

21 Claims, 12 Drawing Sheets

REDUCED SIZE DIELECTRIC LOADED SPIRAL ANTENNA

BACKGROUND OF THE INVENTION

1. Field of the Invention

The present invention relates generally to a spiral antenna. More specifically, the present invention relates to an archimedean spiral antenna which has a reduction in the required size of its antenna diameter and length.

2. Description of the Prior Art

In the past the design of spiral antennas has been limited by two criteria with respect to the spiral antenna's lowest desired frequency of operation. First, the diameter for a sum type mode of operation (simple cosine power pattern) has to be a minimum of one wavelength divided by PI. The length of a typical spiral antenna assembly with an embedded printed circuit balun feed need to be one half wavelength.

For example, a spiral antenna which is required to operate at one Gega-hertz (GHz) without a serious decrease in gain would result in a spiral antenna with a diameter of 3.75 inches and a length of 6.0 inches.

However, for this example, there is a need to reduce the diameter for a spiral antenna from 3.75 inches to about 2.0 inches and perferably about 1.85 inches. Further, for this example, there is also a need to reduce the length of the spiral antenna to about 2.5 inches and provide for a volume reduction by a factor of five.

Previous designs for spiral antenna size reduction have used dielectric loading with limited success. The frequency bandwidth has been limited to approximately 2 to 1, and length reduction has not been addressed.

SUMMARY OF THE INVENTION

The present invention overcomes some of the disadvantages of the past including those mentioned above in that it comprises a very efficient and effective spiral antenna having a substantial reduction in size while providing for the desired frequency of operation.

The present invention consist of an archimedian spiral antenna having a pair of antenna arms mounted on a dielectric substrate. A printed circuit balun is utilized to connect the antenna which has an impedance of 100 ohms to a 50 ohm cable.

Two unique features of the spiral antenna design provide for size reduction at a given lowest required frequency of operation. The spiral antenna has dielectric material layers positioned on both side of the antenna's metal arms. This enables a reduction in the required size of the antenna diameter.

In addition, the antenna input impedance is reduced from the normal 100 ohm input impedance to approximately 50 ohms due the dielectric material. This reduces the length of the printed circuit balun needed to provide signal balance to the spiral antenna. The design of the spiral antenna, virtually eliminates balun circuit length normally required to provide impedance taper which is typically from 100 ohms to 50 ohms. The balun has minimal length, with the overall antenna length being determined by the thickness by a microwave energy absorber utilized by the spiral antenna.

DETAILED DESCRIPTION OF A PREFERRED EMBODIMENT

Figures 3A, 3B, 3C:
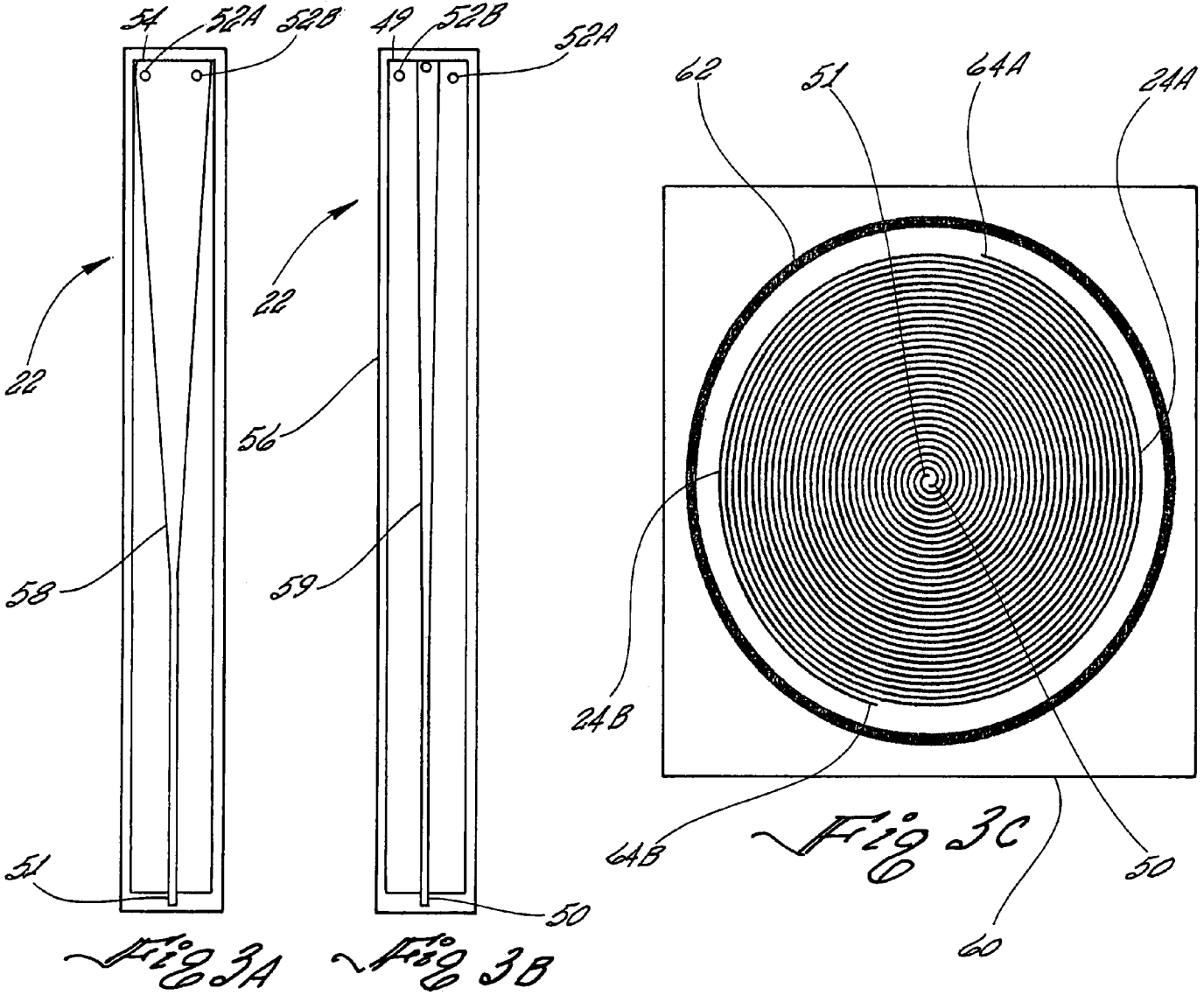

Referring to FIGS. 1, 3A, 3B and 3C, FIG. 1 is a block diagram illustrating the spiral antenna 20 comprising the present invention. The antenna can have either an archimedean spiral geometry as shown in FIG. 3C or a logarithmic spiral geometry. The spiral antenna 20 has a pair of spiral arms 24A and 24B mounted on a dielectric substrate 60 (FIG. 3C). The antenna arms 24A and 24B are respectively connected to a balun 22 (depicted in FIGS. 3A and 3B) by antenna signal arm inputs 50 and 51 which are positioned at the center of spiral antenna 20. Each of the antenna arms 24A and 24B of spiral antenna 20 is also connected to a spiral arm load 26 at a pair of load connection terminals 64A and 64B. As shown in FIG. 3C, the antenna arm signal inputs 50 and 51 are located at the inner end of antenna arms 24A and 24B, while the load connection terminals 64B and 64B are located at the outer end of antenna arms 24A and 24B.

The spiral arm loads 26 used in the preferred embodiment are resistors of approximately fifty ohms which are connected to the spiral antenna arms 24A and 24B and a metallic ring 62 formed around antenna arms 24A and 24B of spiral antenna 20 on dielectric substrate 60. The resistors attenuate residual currents on the antenna arms 24A and 24B which remain after the antenna radiates its energy.

The balun 22 is a printed circuit tapered microstrip balun with a signal input 49 having an impedance of fifty ohms. Both sides 54 and 56 of balun 22 are tapered in the manner illustrated in FIGS. 3A and 3B. The ground side of balun 22 is side 54 and the input side of balun 22 is side 56.

The input side 56 of balun 22 is connected to antenna arm signal input 50, and the ground side 54 of balun 22 is connected to antenna arm signal input 51. The input circuit line 59 of input side 56 tapers in either an exponential, or linear fashion from an input line width at input 49 to a different line width at connection point 50 to the antenna arm. The ground side 54 has a microstrip line 58 which tapers from a width at the signal input 49 which is three times the width of the input line 59 to a width equal to the input line 59 at the connection point 51. At the connection points 50 and 51 there are two lines of equal width, directly opposite each other on each side 54 and 56 of the circuit substrate/dielectric substrate 60. The circuit substrate 60 is a low dielectric material such as Rogers Corporation 3210 laminate material commercially available from Rogers Corporation, Advanced Circuit Materials Division of Chandler, Ariz. The Balun Circuit 22 provides a balanced signal input to the spiral antenna 20 with the two currents having equal amplitudes, an opposite phase and the same impedance to a virtual ground between them. Balun 22 also has a pair of screw holes 25A and 52B located at the upper end of balun 22.

The spiral antenna 20 has dielectric layers on each side of the two antenna arms 24A and 24B. These dielectric layers, which have reference numerals 28A and 28B (for dielectric layer one) and 30A and 30*b* (for dielectric layer "N") are designed to slow down or reduce the propagation velocity of currents along the antenna arms 24A and 24B. This makes the spiral antenna 20 electrically larger with respect to a free space deign.

The dielectric constant for dielectric layers 28A and 28B which are located next to the antenna arms 24A and 24B of antenna 20 can vary from a high of about 20 to about 10, depending upon the degree of size reduction needed. The remaining dielectric layers including the nth dielectric layers 30A and 303 change from the value for layers 24A and 24B to a dielectric constant of 4.0. The thickness and number of dielectric layers are determined by the highest desired frequency of operation. When the antenna 20 is required to operate at very high frequencies, a substantial number of thin layers are required which change minimally in dielectric constant from layer to layer. Lower frequencies of operation for antenna 20 allow for the use of less dielectric layers which are thicker.

In addition, dielectric layering lowers the input impedance of the antenna. With a dielectric material having a dielectric constant of 10.0 positioned next to the antenna arms 24A and 24B, the input impedance for antenna 10 is close to fifty ohms. This allows the balun 20 to have a circuit length which is very small. Effectively little or no circuit length of balun 20 to perform a 50 ohm to 100 ohm impedance match over a 2:1 or larger frequency band.

Antenna 20 also has a cavity absorber 32 which is positioned in proximity to the spiral antenna arms 24A and 24B. The absorber 32 can be any commercially available microwave absorption material, such as an Advanced ElectroMagnetics Inc. 4.5 inch absorber commercially available from Advanced ElectroMagnetics Inc. of San Diego, Calif. The absorber 32 allows for a frequency of operation of 500 MHz which is the lowest frequency of operation.

Figure 4:
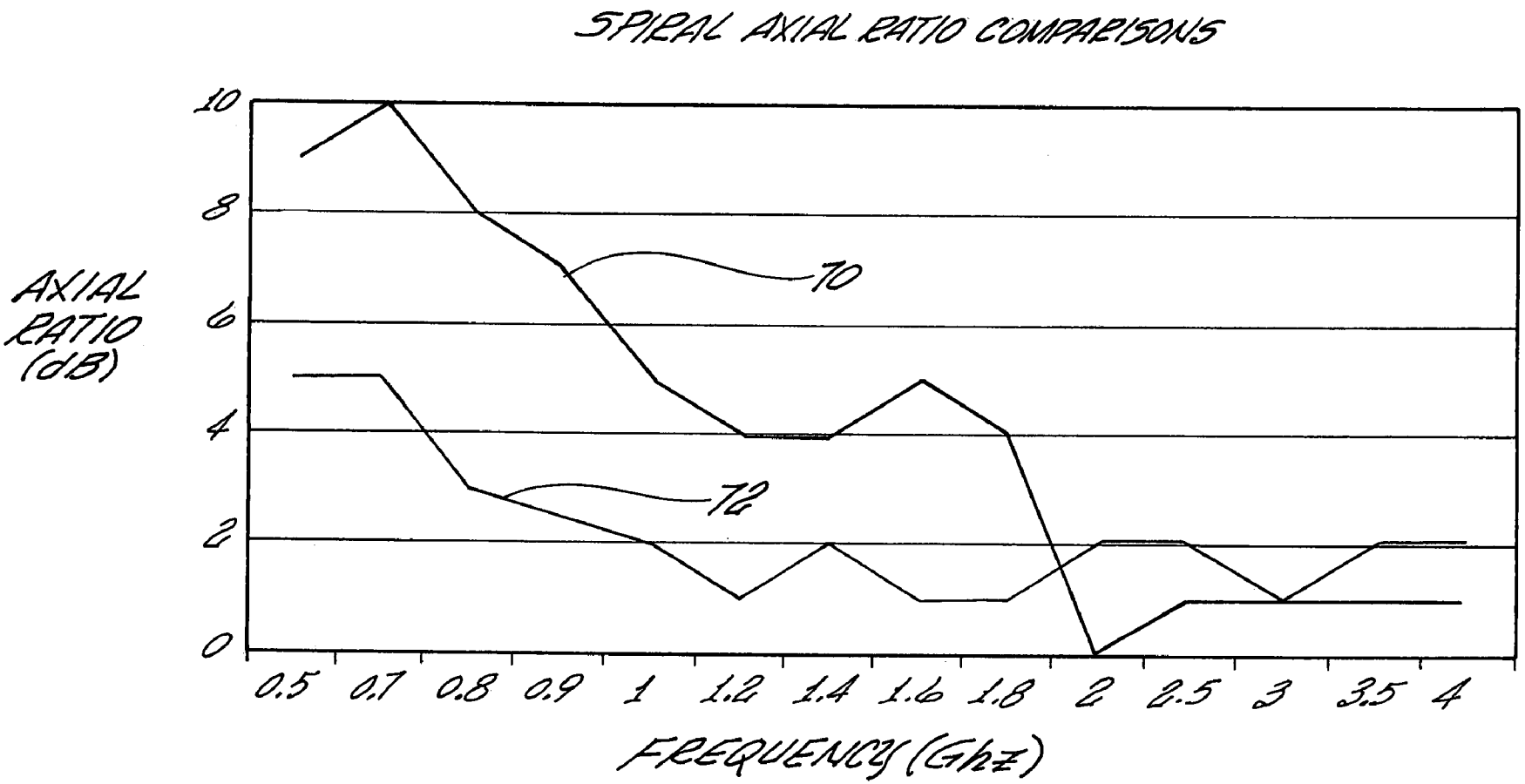
FIGS. 4–12 illustrate performance curves plots for the reduced size spiral antenna of FIG. 1.

The plots 70 and 72 of FIG. 4 depict spiral axial ratio comparisons for a conventional design for a spiral antenna (plot 70) and an extended frequency design according to the preferred embodiment of the present invention (plot 72).

The plots 70 and 72 of FIG. 4 depict spiral axial ratio comparisons for a conventional design for a spiral antenna (plot 70) and an extended frequency design according to the preferred embodiment of the present invention (plot 72).

Figure 5:
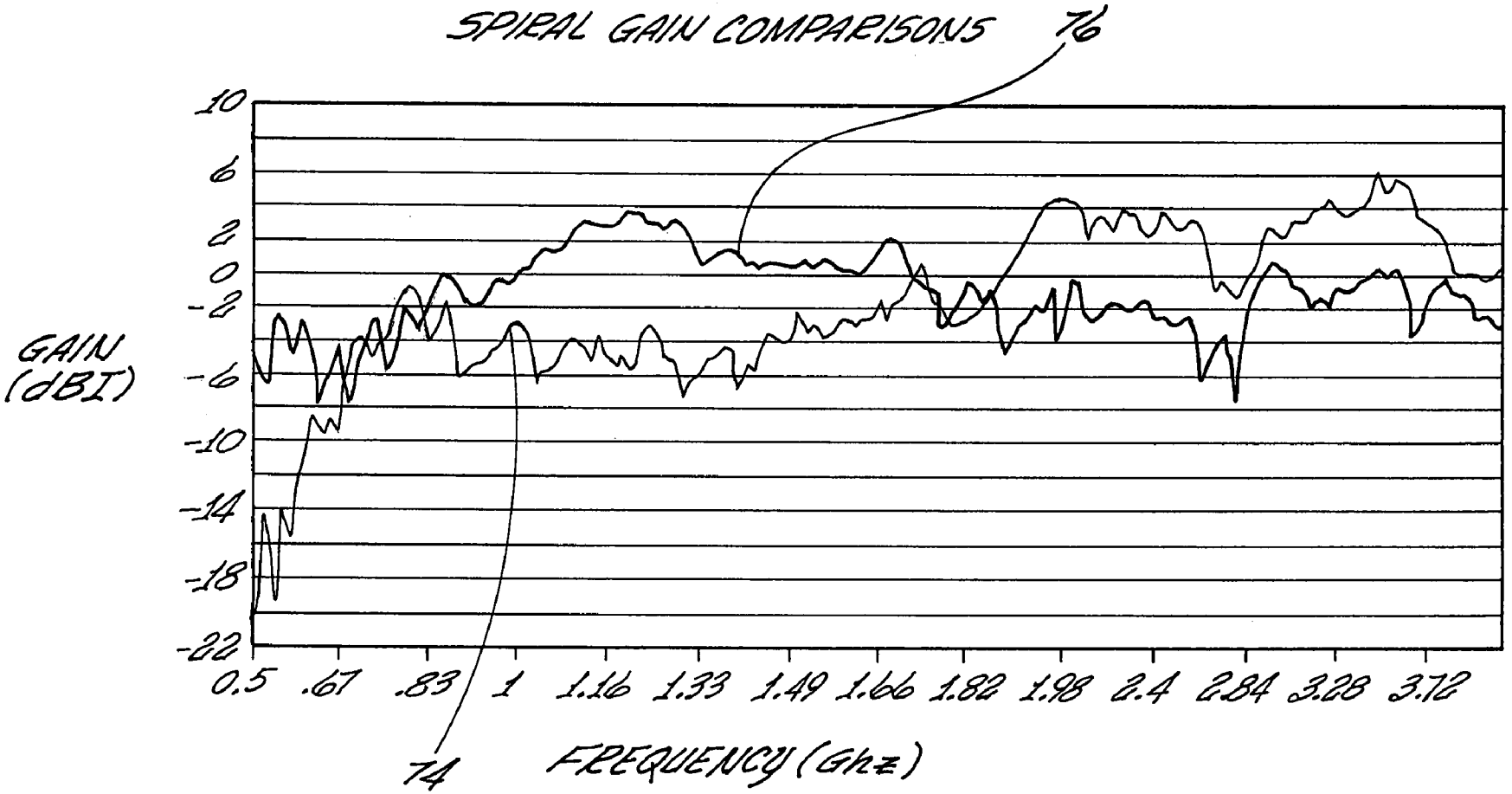

Similarly, the plots 74 and 76 of FIG. 5 depict spiral antenna gain comparison for a conventional spiral antenna design (plot 76) and the extended frequency design of the present invention (plot 74). It should be noted that the gain at the lower frequencies (500 to 700 MHz) shows a substantial improvement over the gain for a conventional spiral antenna.

The initial antenna design consisted of an Archimedian spiral with an arm width of 35 mils and spacing between adjacent arms of 35 mils. The balun for this design provide for an impedance transform of 50 to 100 ohms since two arm spirals typically have an input impedance in the 100 ohm balance range. The balun was etched on a 0.0625 inch thick Duroid 5880 material. The width of the balun was set for a 50 ohm conventional microstrip connector at the signal input end of the balun and for a 100 ohm balance microstrip at the antenna connection points. The balun in the initial design was approximately nine inches in length. A linear taper for the balun between the starting and ending line widths on both top and bottom sides was found to be effective and thus acceptable.

The dielectric layers stacked on each side of the two antenna arms were Duroid R03210 with a dielectric constant of ten. A spiral etch for the antenna arms with fifty mils of overlay on each side of the conductors was sufficient to substantially confine the filed within the dielectric substrate and provide a gain of +5 dBi over the band.

The cavity design was for nine inches long with a graded absorber.

Figure 1:
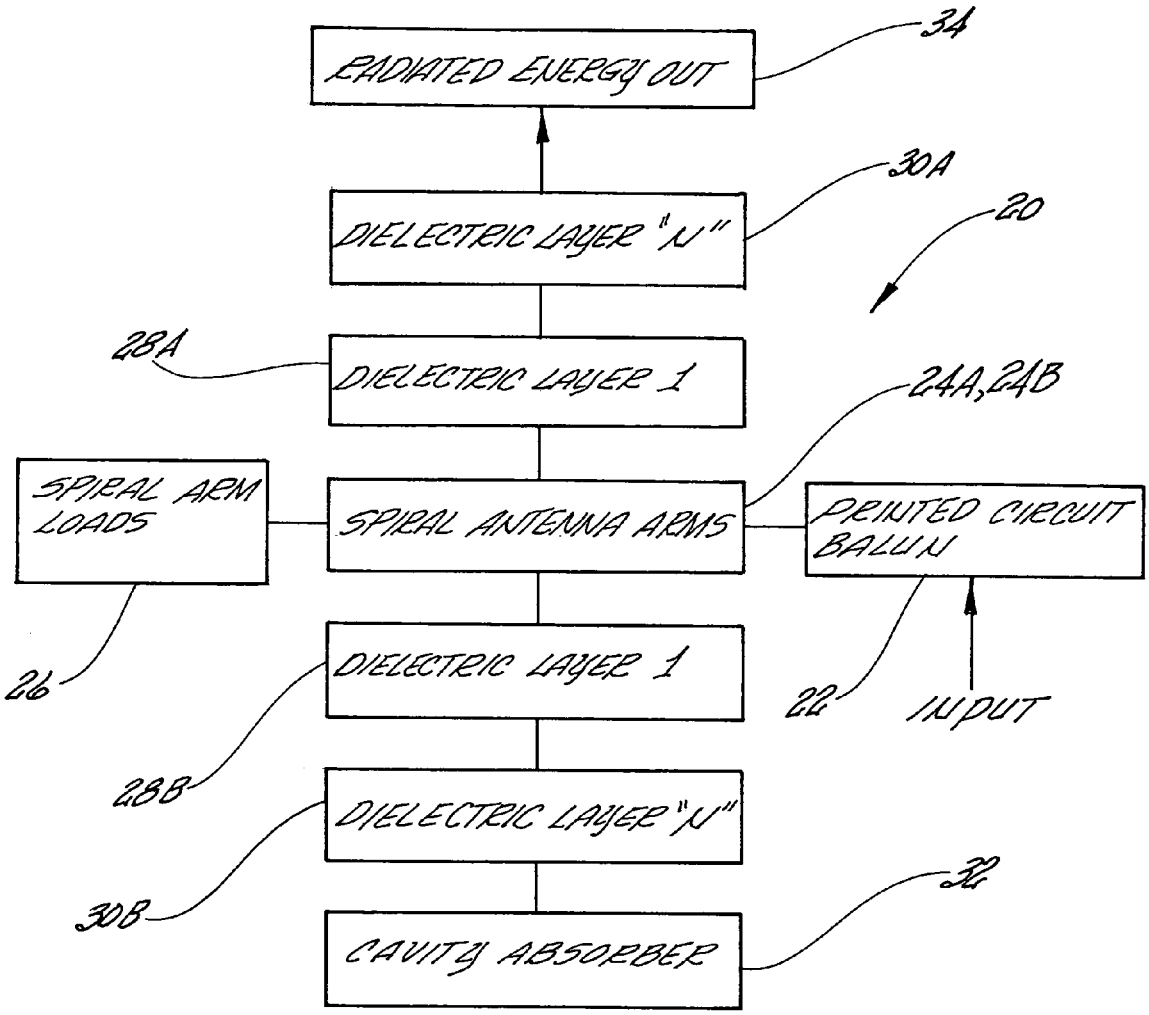
FIGS. 1, 2, 3A, 3B and 3C illustrate a preferred embodiment of the reduced size spiral antenna with loads comprising the present invention.
Figure 2:
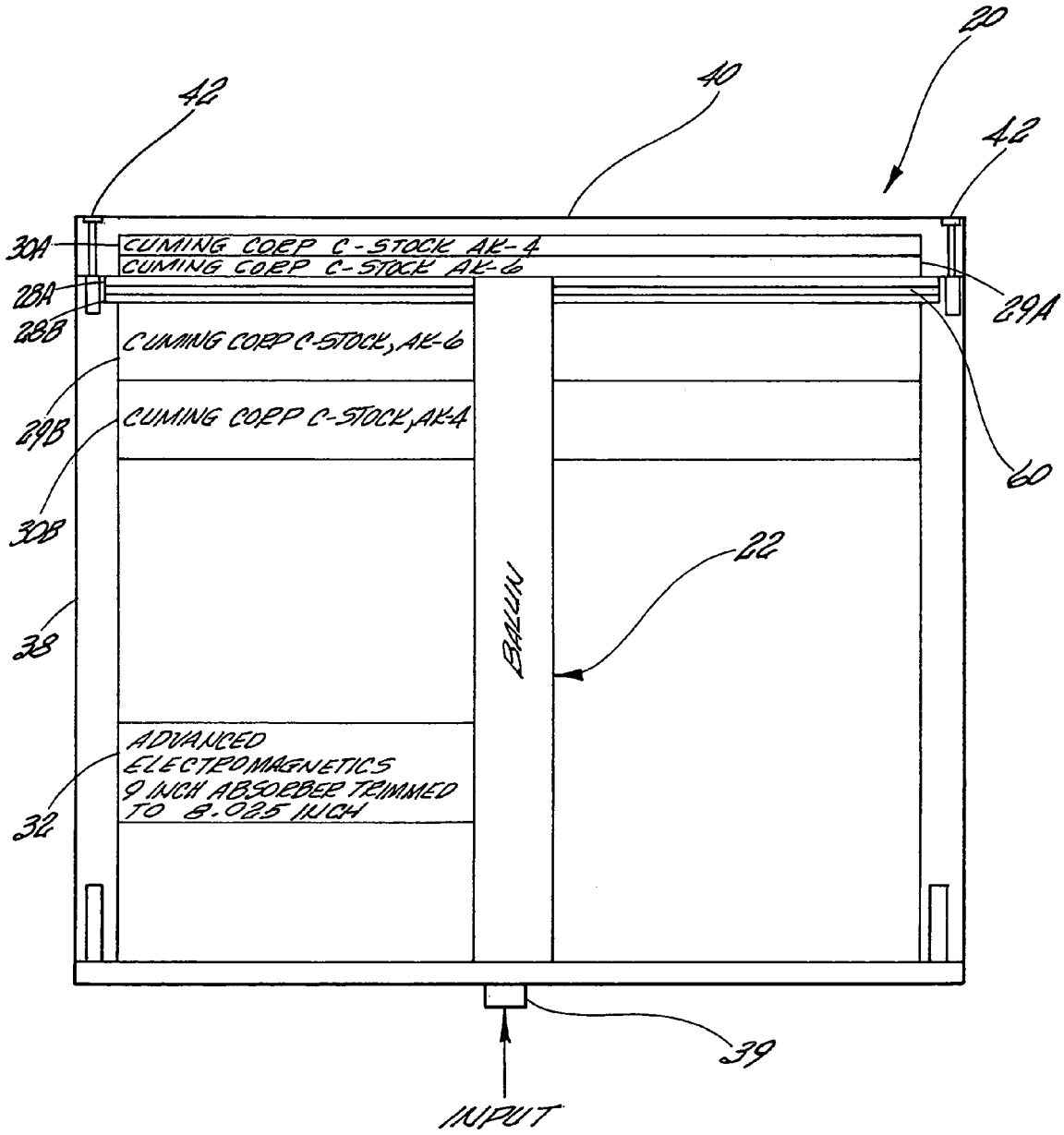

Referring to FIG. 2, FIG. 2 depicts the assembly view for the final design of the spiral antenna. The spiral antenna 20 of FIG. 2 comprises a housing 38 for the spiral antenna and an acrylic cover 40 secured to upper end of the housing by a plurality of bolts 42. The signal input for the antenna housing 38 is identified by the reference numeral 39 which is adapted to receive a standard 50 ohm co-axial cable.

The final design of the spiral antenna included the following overlay stack:

Layer 1 (dielectric layer 30A), which is facing the atmosphere, comprises a ⅛ inch dielectric layer material having a dielectric constant of 4.0.

Layer 2 (dielectric layer 29A) is a ⅛ inch dielectric layer material having a dielectric constant of 6.0.

Layer 3 (dielectric layer 28A) is a 100 mils dielectric layer material having a dielectric constant of 10.

The antenna's spiral arms and the balun transformer.

Layer 4 (dielectric layer 28B) is a 50 mils dielectric layer material having a dielectric constant of 10.

Layer 5 (dielectric layer 29B) is a 0.5 inch dielectric layer material having a dielectric constant of 6.0.

Layer 6 (dielectric layer 30B) is a 0.5 inch dielectric layer material having a dielectric constant of 4.0.

The graded absorber 32 is positioned below the stack in the manner illustrated in FIG. 2.

The dielectric layer 30A and 30B are Coming Corp. C-stock AK-4 dielectric material, the dielectric layers 29A and 29B are Coming Corp. C-stock AK-6 dielectric material, and the dielectric layers 28A and 28B are Rogers Corp. 3210 dielectric material.

Figure 6:
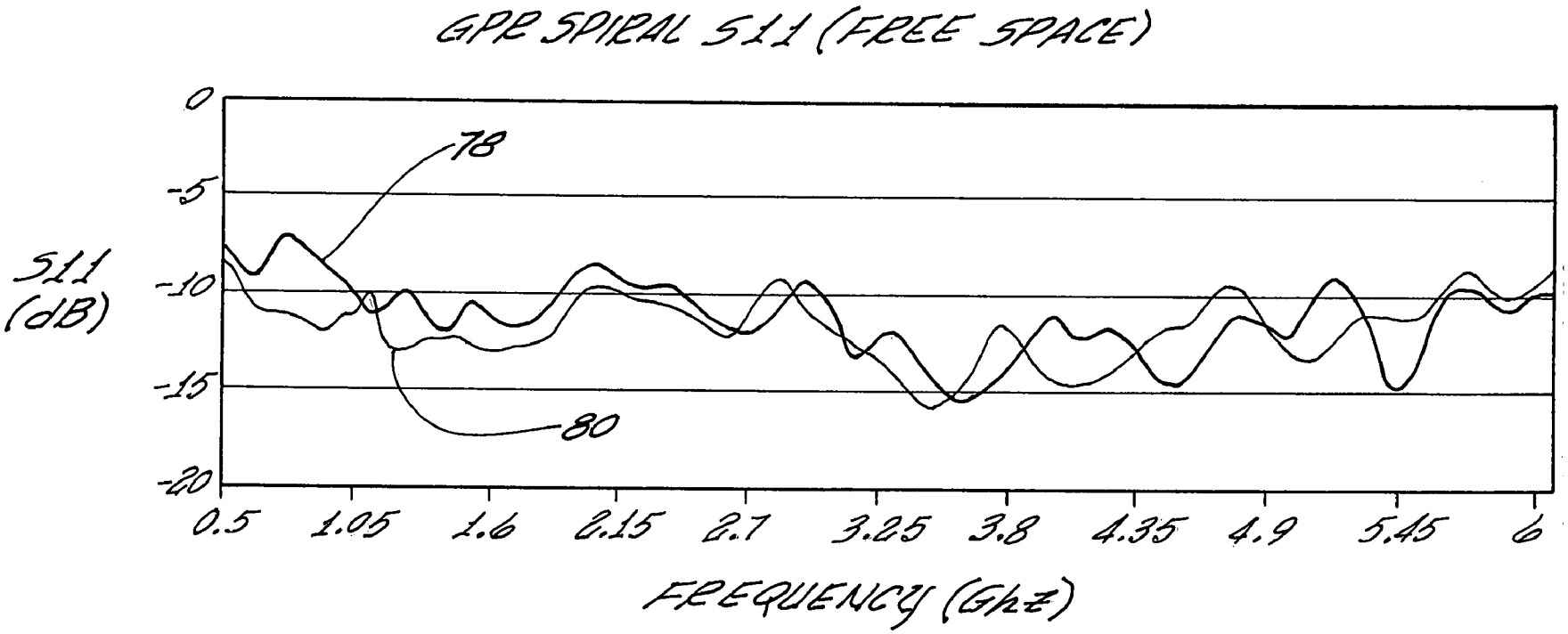

For this design the impedance match turned out be a substantial improvement over the initial design as shown in the plots 78 and 80 of FIG. 6. The initial design of the spiral antenna rarely reached the 10 dB level, the final design of the spiral antenna exceeded 10 dB over a substantial of the band as shown in the plots 78 and 80 of FIG. 6 due to a decrease in the terminal impedance level of the balun.

Utilizing a multi-layer coplaner strip line antenna, the coplaner strip line impedance was calculated to be 77.6 ohms balanced. With a 75 mil line width at the terminal end of the balun on a Duroid 5880 dielectric material, the impedance is 110 ohm balanced or 55 ohms unbalanced to ground.

The computed peak reflection coefficient at the feed point is $(-110+77.6)/(110+77.6)=-0.172$ which is approximately equal to −0.18. This compares favorably to a measured peak reflection of −0.198.

Figure 7:
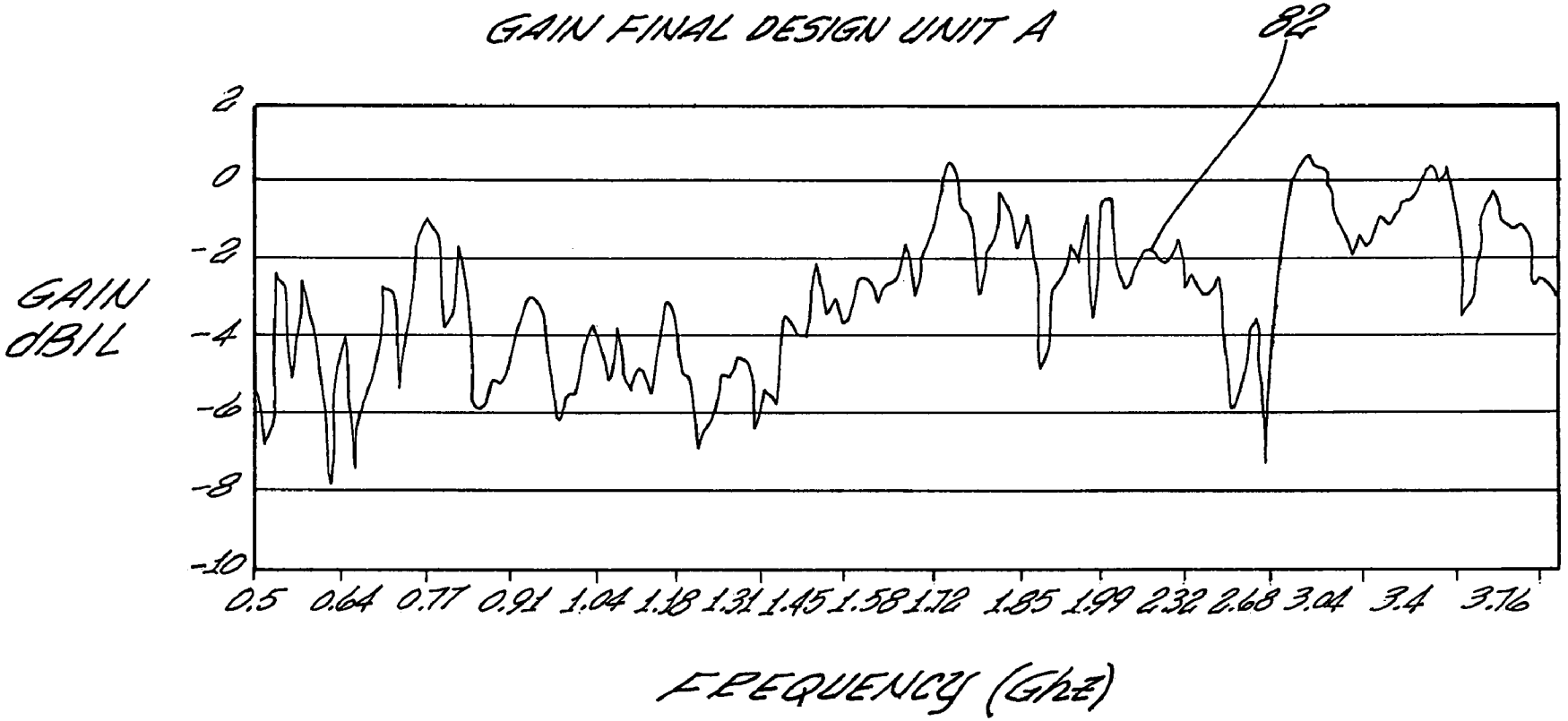

Referring to the plot 82 depicted in FIG. 7, the gain measured at 500 to 700 MHz is significantly improved over the initial design with an overall gain of −8.0 dBIL to about −2.5 dBIL. The final design of the spiral antenna allowed for a workable gain to around 400 MHz, with substantially lower level gains below 400 MHz.

Figure 8:
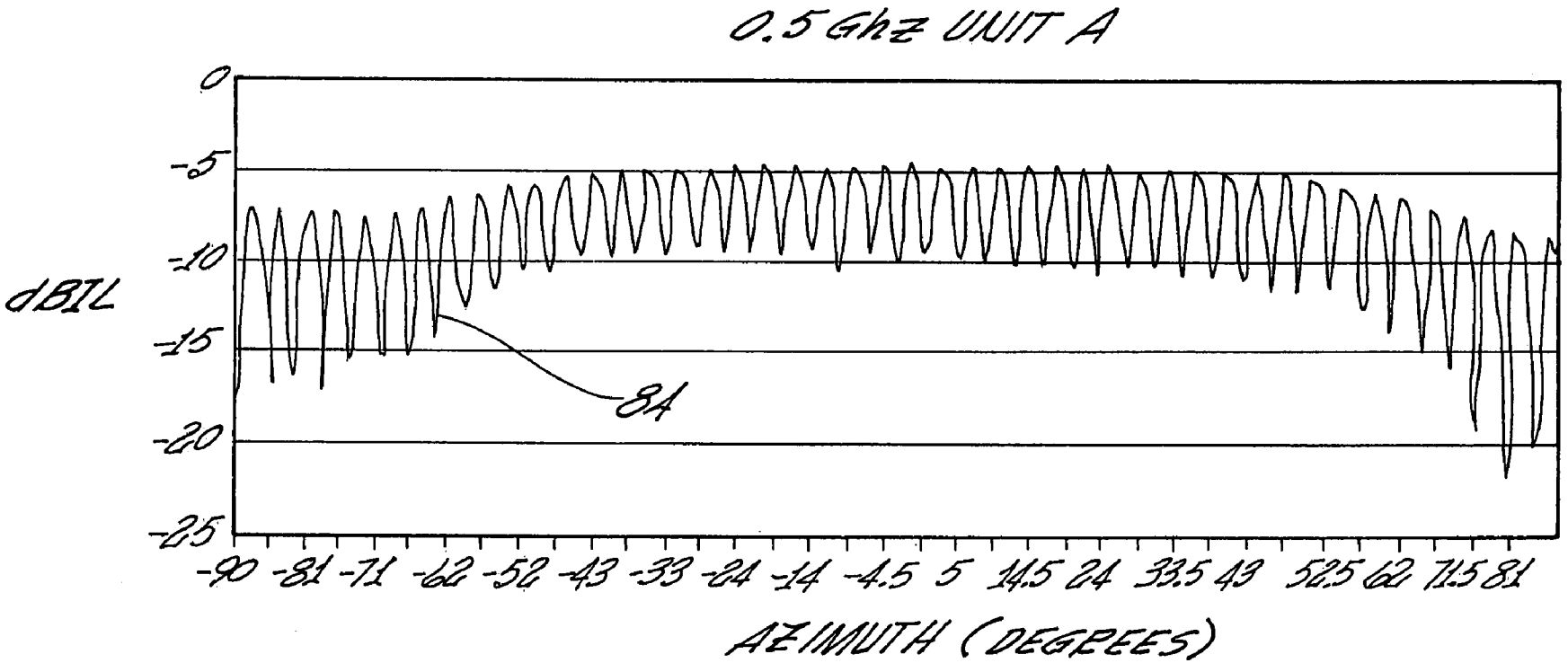
Figure 9:
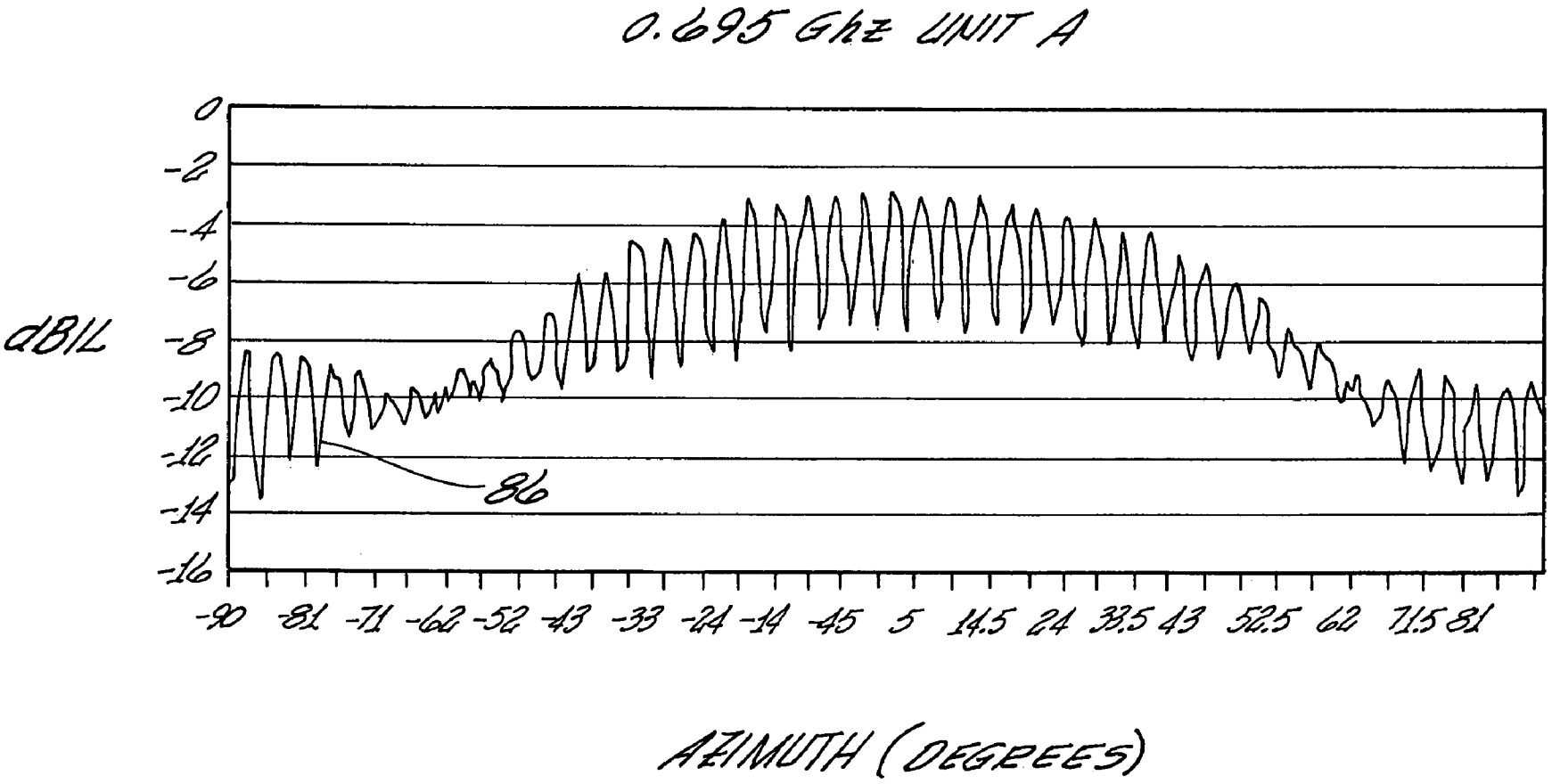
Figure 10:
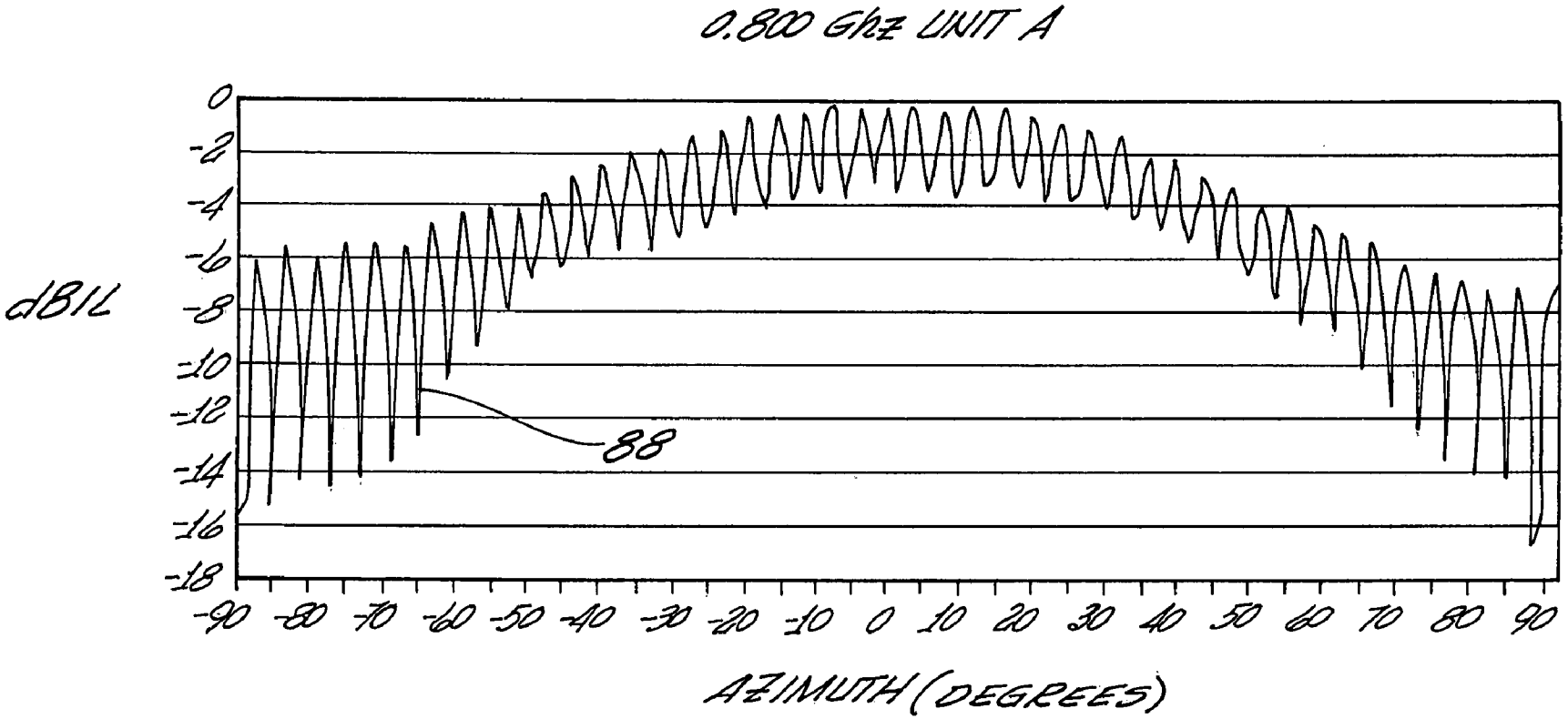
Figure 11:
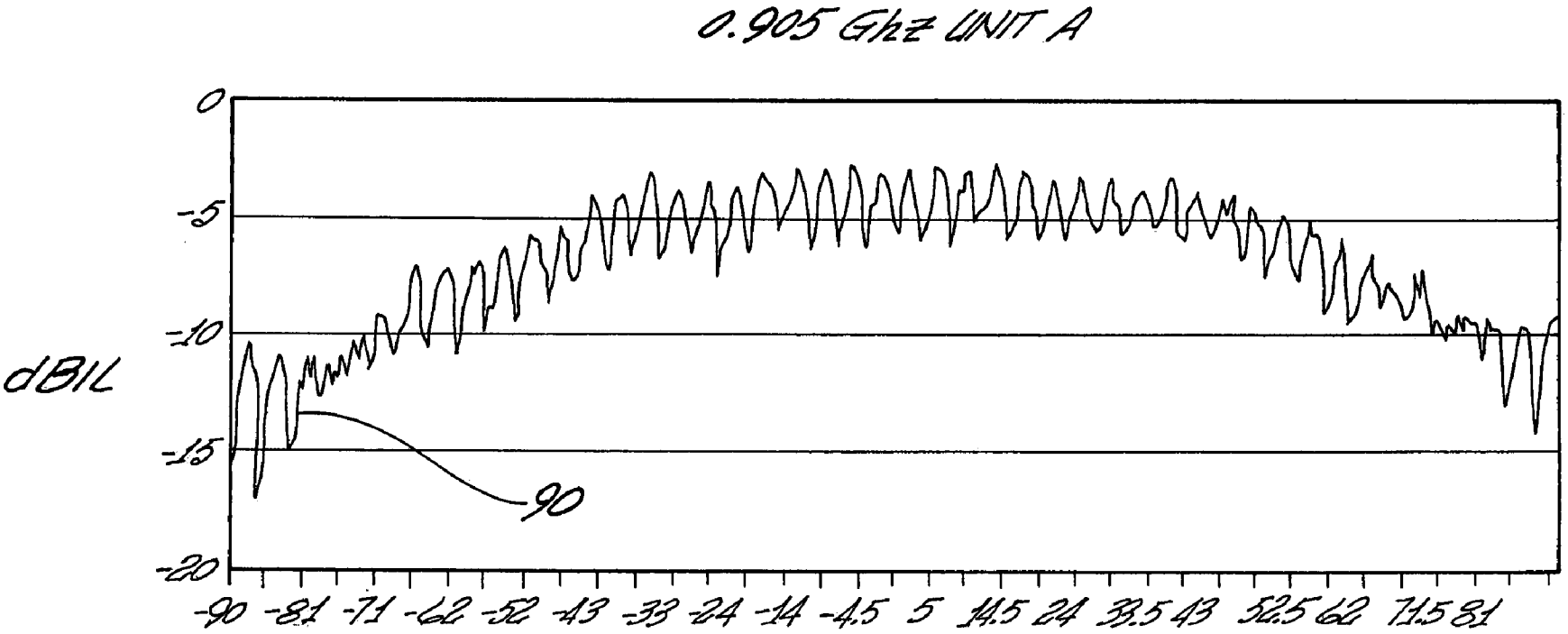
Figure 12:
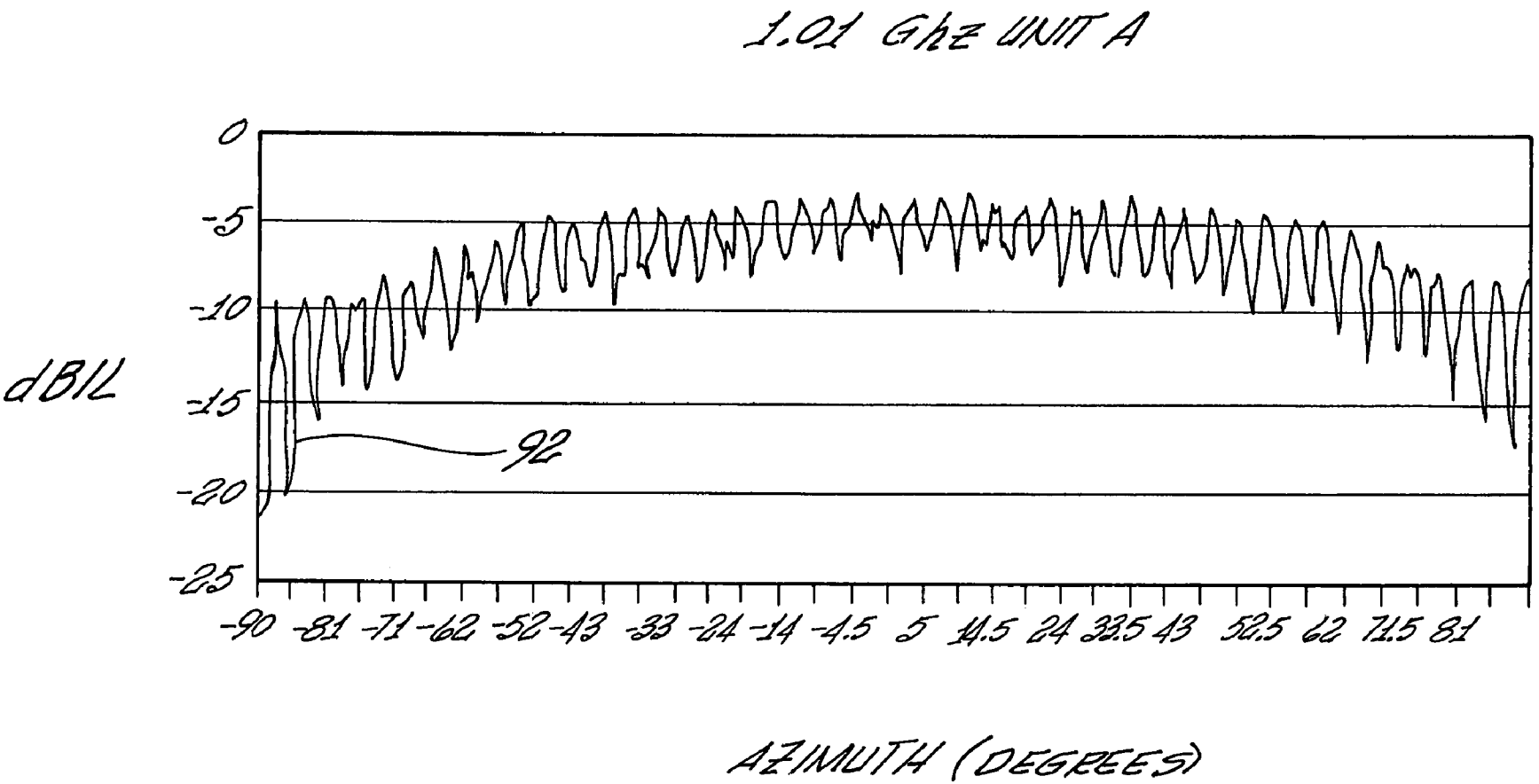

The plots of FIGS. 8–12 illustrate pattern data for the spiral antenna for frequency up to and including 4 GHz. Plot 84 of FIG. 8 illustrates power pattern data at 500 MHz, plot 86 of FIG. 9 illustrates power pattern data at 695 MHz, plot 88 of FIG. 10 illustrates power pattern data at 800 MHz, plot 90 of FIG. 11 illustrates power pattern data at 905 MHz and plot 92 of FIG. 12 illustrates power pattern data at 1010 MHz.

From the foregoing, it is readily apparent that the present invention comprises a new, unique and exceedingly useful and effective reduced size dielectric loaded spiral antenna which constitutes a considerable improvement over the known prior art. Many modifications and variations of the invention are possible in light of the above teachings. It is therefore to be understood that within the scope of the appended claims that the invention may be practiced otherwise than as specifically described.

What is claimed is:

1. A reduced size dielectric loaded spiral antenna comprising:

(a) a dielectric substrate;

(b) a spiral antenna having first and second antenna arms for radiating microwave energy, said spiral antenna being mounted on said dielectric substrate;

(c) a balun having one end thereof being adapted to receive a fifty ohm cable and an opposite end thereof having first and second antenna signal arm inputs, the first antenna signal arm input of said balun being connected to an inner end of said first antenna arm and the second antenna signal arm input of said balun being connected to an inner end of said second antenna arm;

(d) a first plurality of stacked dielectric layers having dielectric constants in a range from about 4.0 to about 20.0, said first plurality of stacked dielectric layers being disposed on one side of said dielectric substrate above said spiral antenna;

(e) a second plurality of stacked dielectric layers having dielectric constants in a range from about 4.0 to about 20.0, said second plurality of stacked dielectric layers being disposed on an opposite side of said dielectric substrate below said spiral antenna, wherein said first plurality of stacked dielectric layers, and said second plurality of stacked dielectric layers provide for a size reduction of said spiral antenna; and (f) said first plurality of stacked dielectric layers, and said second plurality of stacked dielectric layers providing for a size reduction of said balun and an impedance match between said fifty ohm cable and the first and second antenna arms of said spiral antenna.

2. The reduced size dielectric loaded spiral antenna of claim 1 further comprising first and second resistive loads, said first resistive load being connected to an outer end of said first antenna arm and said second resistive load being connected to an outer end of said second antenna arm, said first and second resistive loads being resistors of approximately fifty ohms.

3. The reduced size dielectric loaded spiral antenna of claim 2 further comprising a metallic ring formed around the first and second antenna arms of said spiral antenna and mounted on said dielectric substrate, said first and second resistive loads being connected to said metallic ring.

4. The reduced size dielectric loaded spiral antenna of claim 3 wherein said first and second resistive loads attenuate residual currents remaining on said first and second antenna arms after said microwave energy radiates from said spiral antenna.

5. The reduced size dielectric loaded spiral antenna of claim 1 further comprising a housing having a cover secured to an upper end of said housing and an interior, said dielectric substrate, said spiral antenna, said first plurality of stacked dielectric layers, and said second plurality of stacked dielectric layers being disposed within the interior of said housing.

6. The reduced size dielectric loaded spiral antenna of claim 1 further comprising a cavity absorber which is positioned in proximity to said first and second antenna arms below said second plurality of stacked dielectric layers, wherein said cavity absorber allows for a frequency of operation of 500 MHz for said spiral antenna which is a lowest frequency of operation for said spiral antenna.

7. The reduced size dielectric loaded spiral antenna of claim 1 wherein said spiral antenna has an operating frequency in a frequency range from 500 MHz to 1.1 GHz.

8. The reduced size dielectric loaded spiral antenna of claim 1 wherein the dielectric constants for said first plurality of stacked dielectric layers and said second plurality of dielectric layers decrease from a dielectric constant of 20 for first dielectric layers within said first and second plurality of stacked dielectric layers which are closest to said spiral antenna to a dielectric constant of 4.0 for dielectric layers "N" within said first and second plurality of stacked dielectric layers which are furthest away from said spiral antenna.

9. A reduced size dielectric loaded spiral antenna comprising:

(a) a dielectric substrate;

(b) an archimedean spiral antenna having first and second antenna arms for radiating microwave energy, said archimedean spiral antenna being mounted on said dielectric substrate;

(c) a balun having one end thereof being adapted to receive a fifty ohm cable and an opposite end thereof having first and second antenna signal arm inputs, the first antenna signal arm input of said balun being connected to an inner end of said first antenna arm and the second antenna signal arm input of said balun being connected to an inner end of said second antenna arm;

(d) first, second and third stacked dielectric layers having dielectric constants in a range from 4.0 to 10.0, said first, second and third stacked dielectric layers being disposed on one side of said dielectric substrate above said archimedean spiral antenna;

(e) fourth, fifth and sixth stacked dielectric layers having dielectric constants in a range from 4.0 to 10.0, said fourth, fifth and sixth stacked dielectric layers being disposed on an opposite side of said dielectric substrate below said archimedean spiral antenna, wherein said first, second, and third stacked dielectric layers, and said fourth, fifth and sixth stacked dielectric layers provide for a size reduction of said archimedean spiral antenna; and (f) said first, second and third stacked dielectric layers, and said fourth, fifth and sixth stacked dielectric layers providing for a size reduction of said balun and an impedance match between said fifty ohm cable and the first and second antenna arms of said archimedean spiral antenna which have an impedance of approximately 100 ohms.

10. The reduced size dielectric loaded spiral antenna of claim 9 further comprising first and second resistive loads, said first resistive load being connected to an outer end of said first antenna arm and said second resistive load being connected to an outer end of said second antenna arm, said first and second resistive loads being resistors of approximately fifty ohms.

11. The reduced size dielectric loaded spiral antenna of claim 10 further comprising a metallic ring formed around the first and second antenna arms of archimedean spiral antenna and mounted on said dielectric substrate, said first and second resistive loads being connected to said metallic ring.

12. The reduced size dielectric loaded spiral antenna of claim 11 wherein said first and second resistive loads attenuate residual currents remaining on said first and second antenna arms after said microwave energy radiates from said archimedean spiral antenna.

13. The reduced size dielectric loaded spiral antenna of claim 9 further comprising a housing having a cover secured to an upper end of said housing and an interior, said dielectric substrate, said archimedean spiral antenna, said first, second, and third stacked dielectric layers, and said fourth, fifth and sixth stacked dielectric layers being disposed within the interior of said housing.

14. The reduced size dielectric loaded spiral antenna of claim 9 further comprising a cavity absorber which is positioned in proximity to said first and second antenna arms below said fourth, fifth and sixth stacked dielectric layers, wherein said cavity absorber allows for a frequency of operation of 500 MHz for said archimedean spiral antenna which is a lowest frequency of operation for said archimedean spiral antenna.

15. The reduced size dielectric loaded spiral antenna of claim 9 wherein said archimedean spiral antenna has an operating frequency in a frequency range from 500 MHz to 1.1 GHz.

16. The reduced size dielectric loaded spiral antenna of claim 1 wherein the dielectric constant for said first and fourth dielectric layers is 10, the dielectric constant for said second and fifth dielectric layers is 6 and the dielectric constant for said third and sixth dielectric layers is 4.0, said first and fourth dielectric layers being closest to said archimedean spiral antenna and said third and sixth dielectric layers being furthest away from said archimedean spiral antenna.

17. A reduced size dielectric loaded spiral antenna comprising:

(a) a dielectric substrate;

(b) an archimedean spiral antenna having first and second antenna arms for radiating microwave energy, said archimedean spiral antenna being mounted on said dielectric substrate;

(c) a balun having one end thereof being adapted to receive a fifty ohm cable and an opposite end thereof having first and second antenna signal arm inputs, the first antenna signal arm input of said balun being connected to an inner end of said first antenna arm and the second antenna signal arm input of said balun being connected to an inner end of said second antenna arm;

(d) first, second and third stacked dielectric layers having dielectric constants in a range from 4.0 to 10.0, said first, second and third stacked dielectric layers being disposed on one side of said dielectric substrate above said archimedean spiral antenna;

(e) fourth, fifth and sixth stacked dielectric layers having dielectric constants in a range from 4.0 to 10.0, said fourth, fifth and sixth stacked dielectric layers being disposed on an opposite side of said dielectric substrate below said archimedean spiral antenna, wherein said first, second, and third stacked dielectric layers, and said fourth, fifth and sixth stacked dielectric layers substantially reduce a propagation velocity for currents along said first and second antenna arms providing for a size reduction of said archimedean spiral antenna;

(f) said first, second and third stacked dielectric layers, and said fourth, fifth and sixth stacked dielectric layers providing for a size reduction of said balun and an impedance match between said fifty ohm cable and the first and second antenna arms of said archimedean spiral antenna which have an impedance of approximately 100 ohms;

(g) first and second resistive loads, said first resistive load being connected to an outer end of said first antenna arm and said second resistive load being connected to an outer end of said second antenna arm, said first and second resistive loads being resistors of approximately fifty ohms;

(h) a metallic ring formed around the first and second antenna arms of archimedean spiral antenna and mounted on said dielectric substrate, said first and second resistive loads being connected to said metallic ring; and (i) a cavity absorber which is positioned in proximity to said first and second antenna arms below said fourth, fifth and sixth stacked dielectric layers, wherein said cavity absorber allows for a frequency of operation of 500 MHz for said archimedean spiral antenna which is a lowest frequency of operation for said archimedean spiral antenna.

18. The reduced size dielectric loaded spiral antenna of claim 17 wherein said first and second resistive loads attenuate residual currents remaining on said first and second antenna arms after said microwave energy radiates from said archimedean spiral antenna.

19. The reduced size dielectric loaded spiral antenna of claim 17 further comprising a housing having a cover secured to an upper end of said housing and an interior, said dielectric substrate, said archimedean spiral antenna, said first, second, and third stacked dielectric layers, and said fourth, fifth and sixth stacked dielectric layers being disposed within the interior of said housing.

20. The reduced size dielectric loaded spiral antenna of claim 17 wherein said archimedean spiral antenna has an operating frequency in a frequency range from 500 MHz to 1.1 GHz.

21. The reduced size dielectric loaded spiral antenna of claim 17 wherein the dielectric constant for said first and fourth dielectric layers is 10, the dielectric constant for said second and fifth dielectric layers is 6 and the dielectric constant for said third and sixth dielectric layers is 4.0, said first and fourth dielectric layers being closest to said archimedean spiral antenna and said third and sixth dielectric layers being furthest away from said archimedean spiral antenna.

* * * * *